US011445796B2

(12) United States Patent
De Brugiere et al.

(10) Patent No.: US 11,445,796 B2
(45) Date of Patent: Sep. 20, 2022

(54) PAIR OF CAPSULES ASSEMBLED TOGETHER AND RESPECTIVELY COMPRISING TWO DIFFERENT PHASES TO BE MIXED

(71) Applicant: LABORATOIRES M&L, Manosque (FR)

(72) Inventors: Philippe De Brugiere, Marly le Roi (FR); Olivier Le Grand, Messigny et Vantoux (FR)

(73) Assignee: LABORATOIRES M&L, Manosque (FR)

( * ) Notice: Subject to any disclaimer, the term of this patent is extended or adjusted under 35 U.S.C. 154(b) by 16 days.

(21) Appl. No.: 16/625,979

(22) PCT Filed: Jun. 22, 2018

(86) PCT No.: PCT/FR2018/051517
§ 371 (c)(1),
(2) Date: Dec. 23, 2019

(87) PCT Pub. No.: WO2018/234715
PCT Pub. Date: Dec. 27, 2018

(65) Prior Publication Data

US 2020/0163434 A1 May 28, 2020

(30) Foreign Application Priority Data

Jun. 23, 2017 (FR) ..... 17 55749

(51) Int. Cl.
*B65D 81/32* (2006.01)
*A45D 34/00* (2006.01)

(52) U.S. Cl.
CPC ..... *A45D 34/00* (2013.01); *B65D 81/3277* (2013.01); *A45D 2034/005* (2013.01); *A45D 2200/058* (2013.01)

(58) Field of Classification Search
CPC ..... B65D 25/082; B65D 51/2857; B65D 51/2864; B65D 81/3277; A45D 34/00;
(Continued)

(56) References Cited

U.S. PATENT DOCUMENTS 2,446,398 A * 8/1948 Wilson ..... A45D 24/24 132/116
2,819,723 A * 1/1958 Meyer ..... A45D 24/22 222/145.5
(Continued)

FOREIGN PATENT DOCUMENTS

EP 0 345 230 12/1989
FR 1 459 620 11/1966
(Continued)

OTHER PUBLICATIONS

Patent Translate Powered by EPO and Google for FR 2894942A1, 8 pages.*
(Continued)

*Primary Examiner* — Luan K Bui
(74) *Attorney, Agent, or Firm* — Nixon & Vanderhye

(57) ABSTRACT

Disclosed is a pair of capsules assembled together and respectively including two different phases to be mixed in order to obtain a personalized cosmetic product, including: two pouches respectively containing the two different phases and respectively included in the two capsules and interconnected by a communication channel including at least one portion of narrow cross-section relative to the two pouches, this portion of narrow cross-section of the communication channel including two right-angle bends.

25 Claims, 8 Drawing Sheets

(58) Field of Classification Search
CPC ..... A45D 2034/005; A45D 2200/058; A61J 1/2093
USPC ..... 206/219–221, 568
See application file for complete search history.

(56) References Cited

U.S. PATENT DOCUMENTS 3,353,261 A 11/1967 Bradford et al.
4,614,437 A * 9/1986 Buehler ..... B01F 13/002 141/319
4,791,149 A * 12/1988 Pocknell ..... A61F 13/04 206/221
4,952,068 A 8/1990 Flint
5,318,203 A * 6/1994 Iaia ..... B65D 81/3288 222/94
5,509,898 A * 4/1996 Isono ..... A61J 1/2093 128/DIG. 24
5,848,730 A * 12/1998 Kawase ..... B65D 83/0011 222/105
6,655,524 B2 * 12/2003 De Laforcade .... B65D 81/3211 206/222
7,625,114 B2 * 12/2009 Suchan ..... B65D 75/327 206/219
8,226,126 B2 * 7/2012 Johns ..... B01F 15/0212 285/3
2004/0004010 A1 * 1/2004 Versluys ..... B65D 75/5883 206/219
2016/0113377 A1 4/2016 Moussion et al.

FOREIGN PATENT DOCUMENTS

FR 2 894 942 6/2007
FR 3 026 622 A1 4/2016
JP 3120768 U 4/2006
WO WO 02/22466 3/2002
WO WO 2004/031051 4/2004
WO WO 2007/068862 6/2007
WO WO 2016/102816 6/2016

OTHER PUBLICATIONS

International Search Report, PCT/FR2018/051517, dated Aug. 30, 2018.
Office Action issued in Korean Patent Application No. 10-2020-7002321 dated May 20, 2021.
Office Action issued in Japanese Patent Application No. 2019-570870 dated Feb. 1, 2021.

* cited by examiner

PAIR OF CAPSULES ASSEMBLED TOGETHER AND RESPECTIVELY COMPRISING TWO DIFFERENT PHASES TO BE MIXED

FIELD OF INVENTION

The invention relates to the field of pairs of capsules assembled together and respectively comprising two different phases to be mixed in order to obtain a personalized cosmetic product.

BACKGROUND OF INVENTION

According to prior art, for example described in the patent application FR 1459620, two capsules are introduced into a machine for mixing the two phases they contain in order to produce a personalized cosmetic product that is ready to use. The two capsules are arranged in the extension of one another, which enables completely fluid circulation of the mixture in the communication channel located between the two capsules.

According to the invention, it has been identified that this completely fluid circulation in the communication channel between the two capsules results in a certain bulkiness of the mixing chamber containing these two capsules, especially in length.

The invention, to provide improved compactness of the mixing chamber in order to further miniaturize the mixing machine, proposes a new relative arrangement of the capsules and a new layout of the communication channel interconnecting these two capsules.

SUMMARY OF THE INVENTION

The object of the present invention is to provide a pair of capsules at least partially overcoming the above disadvantages.

More particularly, the invention aims to provide a pair of capsules interconnected by a communication channel between capsules which comprises two right-angled returns, thus preferably forming the three sides of a rectangle. The savings in space occupied by the capsules is substantial because the overall size is reduced, particularly lengthwise. In addition, the reluctance to bend the communication channel between capsules, for fear of impeding the fluid circulation of the mixture inside the channel, is overcome; indeed, surprisingly, the mixture circulates in a sufficiently fluid manner in the communication channel between capsules despite the presence of two right-angle bends.

In addition, according to some embodiments of the invention, this compactness with two bends forming right angles in the communication channel facilitates a more efficient arrangement of two interesting functions of a machine into which the pair of capsules can be introduced, namely a first function of expelling the contents of each capsule by the pressure of a piston, the two pistons thus able to be opposite one another, and a second function of heating the contents of the capsules by direct contact with a heating element which thus can be just between the two capsules arranged opposite one another.

To this end, the present invention provides a pair of capsules assembled together and respectively comprising two different phases to be mixed in order to obtain a personalized cosmetic product, comprising: two pouches respectively containing the two different phases and respectively included in the two capsules and interconnected by a communication channel comprising at least one portion of narrow cross-section relative to the two pouches, this portion of narrow cross-section of the communication channel comprising two right-angle bends.

Preferably, the two right-angle bends are arranged such that at least part of the portion of narrow cross-section of the communication channel comprising the two right-angle bends forms the three sides of a rectangle. According to the invention, there is also provided a pair of capsules comprising two pouches respectively containing the two different phases and respectively included in the capsules and interconnected by a communication channel comprising at least one portion of narrow cross-section relative to the two pouches, this portion of narrow cross-section of the communication channel comprising at least two portions parallel to each other and a connection between these two portions.

The invention also relates to a capsule comprising only one of the two phases which when mixed form a personalized cosmetic product, comprising a pouch containing said phase and included in said capsule which is intended to be connected, by a communication channel comprising at least one portion of narrow cross-section relative to said pouch, to another capsule in which a pouch contains the other of the two phases of said mixture, part of this portion of narrow cross-section of the communication channel comprising a right-angle bend.

According to preferred embodiments, the invention comprises one or more of the following features of which one, some, or all of them may be combined, with one or the other of the above objects of the invention.

Preferably, the ratio between the narrow cross-section of the communication channel and the cross-section of one or the other of said pouches is sufficiently small to cause shear of the mixture of formulations which passes through it.

The mixture of the two phases respectively contained in the two capsules is thus more homogeneous.

Preferably, the portion of narrow cross-section of the communication channel comprises a male connector part and a female connector part which are respectively part of the two capsules and which fit one inside the other.

Thus, assembling the capsules together and interconnecting them by a communication channel is achieved simply and in a fluidtight manner using a connector that is already pre-installed and distributed between the two capsules, one connector part per capsule.

Preferably, the male and female connector parts fitted one inside the other are arranged in the intermediate side of the three sides of the rectangle formed by the communication channel, which is orthogonal to the other two sides of the rectangle.

Thus, the connection between connector parts is approximately at the middle of the communication channel between the two capsules, each capsule carrying an equivalent portion of the communication channel before the junction.

Preferably, one of said bends is arranged at the inner end of the male connector part which is opposite the outer end of the male connector part intended to fit first into the outer end of the female connector part, and the other of said bends is arranged at the inner end of the female connector part which is opposite the outer end of the female connector part intended to fit first into the outer end of the male connector part.

Thus, the connection between the connector part and the rest of the communication channel leading to one or the other of the capsules is established at one or the other of the two bends, which simplifies the connection.

Preferably, the male connector part is a molded plastic hollow tube with a molded plastic flange located opposite the outer end of the male connector part, and the female connector part is a molded plastic hollow tube with a molded plastic flange located opposite the outer end of the female connector part, the flanges preferably being integral with their respective hollow tubes, the molded plastic preferably being injected polymer, advantageously polypropylene or polyethylene Pre-assembly of one or the other of the connector parts to the rest of the communication channel leading to one or the other of the capsules is thus done in a manner that is both simple and robust.

Preferably, each of the flanges is welded to a film closing the pouch of the capsule which does not contain said flange.

The film thus has a firm and flat support to which it can be simply and securely fixed, preventing it from detaching unexpectedly.

Preferably, each pouch is flattened, one of its two faces being flat, the other of its two faces being at least partly convex and flexible to allow expelling the contents of the pouch by mechanical pressure on said pouch.

The simplicity of its use is thus improved. On the one hand, the flat face of the pouch allows simple and uniform heating of each of the capsules. On the other hand, the convex and flexible face of the pouch provides a simple way of completely expelling the contents of the pouch by simple mechanical pressure on the pouch of the capsule.

Preferably, the at least partly convex face of the pouch is formed by a thermoformed shell containing said phase, and the flat face of the pouch is formed by a film covering this shell, the film preferably being welded to this shell, advantageously by thermal heating.

The asymmetrical shape of the pouch of each capsule is thus achieved in a simple manner while obtaining a capsule pouch that will remain robust.

Preferably, one face of the channel is at least partly convex, and preferably is formed by a thermoformed shell, and the other face of the channel is at least partly flat, and preferably is formed by a film covering this shell, the film preferably being welded to the shell, advantageously by thermal heating.

The simplicity of the manufacture is thus improved because the film, which is flat, simply covers a shell, which is three-dimensional but preformed. Having a single structure, namely a shell covered by a film, makes it possible to simultaneously produce both the capsule pouch and the communication channel portion extending from this capsule pouch.

Preferably, the thermoformed shell is multilayer and advantageously comprises an inner layer of polyolefin polymer, and the film is multilayer and advantageously comprises an inner layer of polyolefin polymer.

Polyolefin polymer is a material that is particularly well-suited for welding to itself.

Preferably, the flat faces of the two capsules are arranged face to face.

The heating element can thus easily be slid between the two capsules by having a simple shape of constant thickness.

Preferably, the capsules are disposable deformable capsules.

The structure of the capsules can then be simplified, with simple frangible sealings that can for example replace valves.

Preferably, the capsules are arranged opposite one another.

The gain in compactness is further improved. The functions of expelling the contents of the capsule and heating the contents of the capsule can be implemented in a manner which is also less cumbersome, simpler, and more convenient.

Preferably, the narrow portion of the channel has, at least for part of its length, a cross-section smaller than 10 $mm^2$, preferably less than 5 $mm^2$, even more preferably less than 2 $mm^2$.

Thus, there is better creation of shear in the mixture passing through this narrow portion of the channel, across a reduced number of crossings of this narrow portion of the channel, which makes it easier and faster to homogenize the mixture.

Preferably, said channel is of constant cross-section along most of its length, preferably its entire length.

Thus, the acceleration of the mixture as it passes through the channel combined with the accompanying drop in pressure, followed by the deceleration of the mixture with the accompanying increase in pressure, encourages shear in the mixture after this passage, and therefore improves the homogenization in this mixing of the contents of the pouches of two separate capsules.

Preferably, said channel portion of constant cross-section has a cross-section of between 0.5 and 3 $mm^2$, preferably between 1 and 2 $mm^2$.

This small value for the channel cross-section thus accelerates the mixture passing through the channel and reduces its pressure, thereby improving the shear of the mixture exiting the channel, the shear becoming more significant and thereby improving homogenization in the mixing of the contents of the pouches of two separate capsules.

Preferably, said channel has a size or diameter which is at most 20% of the size or diameter of the pouch, preferably at most 15%, more preferably at most 12%. Preferably, said channel has a size or diameter which is at least 2% of the size or diameter of the pouch, preferably at least 4%, more preferably at least 8%.

These values for the ratios between the size of the channel and the size of the pouch ensure, firstly, a preferred maximum value for the relative narrowing threshold which makes it possible to obtain a particularly advantageous shear threshold and therefore homogenization threshold, and secondly, a preferred minimum value for the relative narrowing threshold which makes it possible to maintain an advantageously short traversal time to transfer the mixture from the pouch of one capsule to the other pouch of the other capsule.

Preferably, the thickness of the pouch is between 5% and 30% of its length, preferably between 10% and 20% of its length. Preferably, the thickness of the pouch is between 10% and 50% of its width, preferably between 20% and 40% of its width.

These size ratios facilitate deformation of the capsule pouch, without requiring the use of soft or thin material. This deformation temporarily increases the volume-to-surface ratio of the pouch, which is useful for easily accommodating the passage of the entire mixture through the channel and into the pouch.

Preferably, said narrowing which forms a channel is sufficiently narrow and sufficiently long for mechanical pressure to be able to transfer the contents of one of said pouches to the other of said pouches, creating shear in said content exiting said narrowing which forms a channel, said shear homogenizing the mixture of said two phases, said homogenized mixture being a cosmetic product directly consumable by the end consumer.

Thus a disposable capsule is provided for producing a cosmetic product directly consumable by the end consumer, for which the obtained mixture is more homogeneous.

Preferably the channel of constant cross-section, formed by the portion of the first channel and the portion of the second channel, has a length between 0.5 and 10 mm, preferably between 1 and 5 mm, more preferably between 2 and 4 mm.

Thus, this combined effect of acceleration and drop in pressure, encouraging shear in the mixture leaving the channel and improving its homogenization, occurs for a longer duration while passing through the channel.

Preferably, said pouches are each sufficiently large to contain all of said mixture, more preferably sufficiently large to contain one and a fourth of all of said mixture, even more preferably sufficiently large to contain one and a half of all of said mixture. Advantageously, the pouches are deformable but not expandable.

Thus, with each transfer of the mixture from one of the pouches to the other pouch, the entire mixture passes through the channel, and not just some or most, thereby reducing the number of transfers required to obtain a given level of homogenization.

Preferably, said first disposable pouch comprises a predetermined amount of an excipient phase of a cosmetic product, and said second disposable pouch comprises a predetermined amount of a phase containing active ingredients of a cosmetic product, said second pouch advantageously being sterilized. The mixing of an excipient phase and a phase containing active ingredients just before use by the end consumer and the production of a single dose for immediate use eliminates the need to add preservatives unnecessary for cosmetic effects and usually employed in conventional cosmetics to allow storing the conventional cosmetic product over time.

Preferably, said first disposable pouch comprises a predetermined amount of a fatty phase of a cosmetic product, and said second disposable pouch comprises a predetermined amount of an aqueous phase of a cosmetic product, said second pouch advantageously being sterilized. The mixing of a fatty phase and an aqueous phase just before use by the end consumer and the production of a single dose for immediate use eliminates the need to add preservatives unnecessary for cosmetic effects and usually employed in conventional cosmetics to allow storing the conventional cosmetic product over time.

The fatty phase or excipient phase determines the type of skincare base, while the aqueous phase or phase containing active ingredients primarily constitutes the active complex.

Preferably, said fatty phase of said cosmetic product may be of different types corresponding to different preparations, and said aqueous phase of said cosmetic product may comprise different groups of active ingredients corresponding to the different skincare needs of the end consumer. The different preparations are for example a lotion or a cream. Thus the end consumer, who may be male or female, can choose the type of skincare base desired, independently of the type of active complex appropriate for his or her skin.

Preferably, the general shape of the connection is substantially perpendicular to the two portions, with two curved connections between said connection and respectively the two portions.

Preferably, the connection is substantially perpendicular to the two portions.

A better compromise is thus obtained between gain in compactness and ease of manufacture.

Other features and advantages of the invention will be apparent from the following description of a preferred embodiment of the invention, given by way of example and with reference to the appended drawings.

DETAILED DESCRIPTION OF INVENTION

Figure 1A:
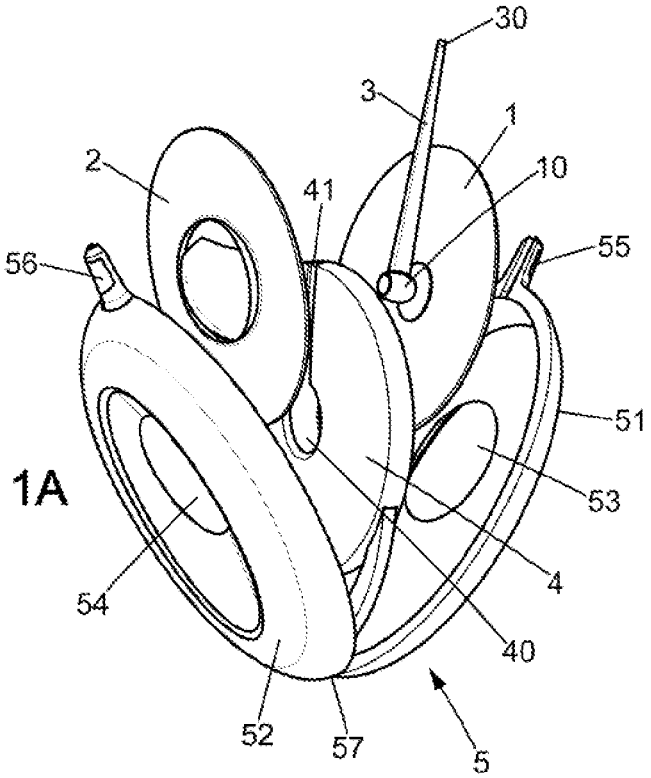
FIG. 1A schematically represents a perspective view of an exemplary shuttle associated with a pair of capsules according to one embodiment of the invention.

FIG. 1A schematically represents a perspective view of an exemplary shuttle associated with a pair of capsules according to one embodiment of the invention.

Figure 1B:
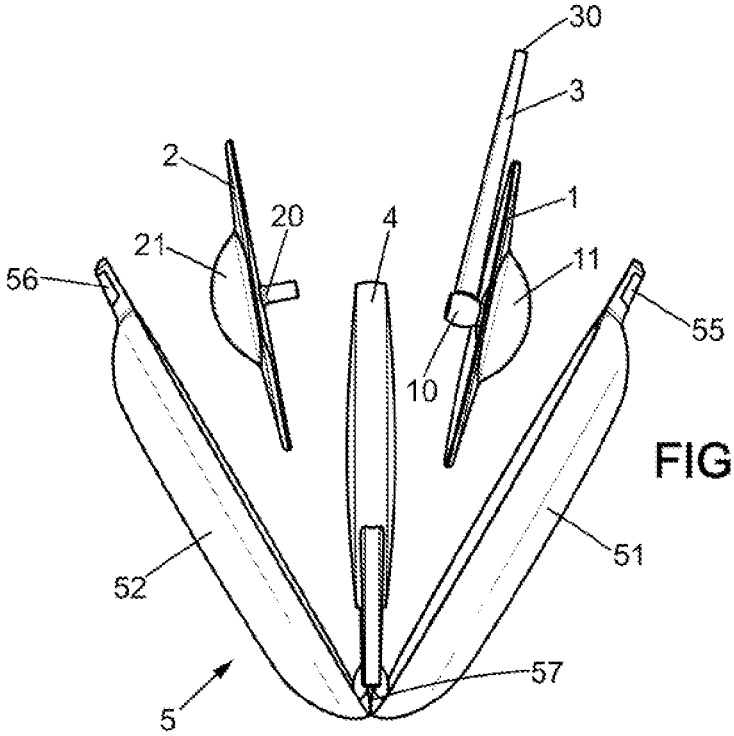
FIG. 1B schematically represents a side view of an exemplary shuttle associated with a pair of capsules according to one embodiment of the invention.

FIG. 1B schematically represents a side view of an exemplary shuttle associated with a pair of capsules according to one embodiment of the invention.

A first capsule 1 comprises a first pouch 11 filled with a first phase of a cosmetic product, a male connector 10, and an outlet passage 3 terminated by an outlet orifice 30.

A second capsule 2 comprises a second pouch 21 filled with a second phase of a cosmetic product, and a female connector 20.

Homogenized mixing of the first phase and second phase yields the cosmetic product ready for use by the user. This cosmetic product is for example a cream for the face that is completely devoid of preservatives. The first phase is for example an aqueous phase that is the active complex, while the second phase is for example a fatty phase that is the excipient.

A shuttle 5 comprises two shells 51 and 52 which rotate about a hinge 57. The first shell 51 comprises a first passage 53 at its center and a first exit guide 55 situated opposite the hinge 57. The second shell 52 comprises a second passage 54 at its center and a second exit guide 56 situated opposite the hinge 57. The shuttle 5 also comprises a heating plate 4 which is attached at the hinge 57, which is pierced at its center by a hole 40 to be traversed by the male connector 10 fitted into the female connector 20, and which comprises a groove 41 intended to receive the outlet passage 3. In place of the passages 53 and 54, the shells 51 and 52 could simply comprise central flexible portions enabling pressure outside the shuttle 5 to be exerted on the pouches 11 and 21 of the capsules 1 and 2.

When the shuttle 5 is opened, the two shells 51 and 52 move apart from each other and from the heating plate 4, and the two capsules 1 and 2 can be introduced one on each side of the heating plate 4.

Figure 2A:
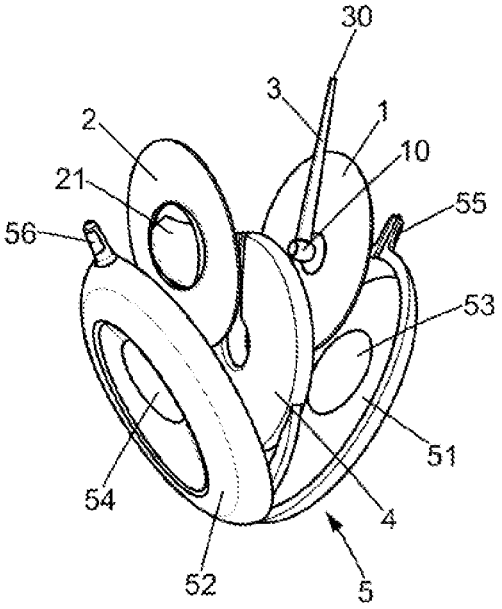
FIG. 2A schematically represents a first step of associating an exemplary shuttle with a pair of capsules according to one embodiment of the invention, which is a step of inserting the pair of capsules into the shuttle.

FIG. 2A schematically represents a first step of associating an exemplary shuttle with a pair of capsules according to one embodiment of the invention, which is a step of inserting the pair of capsules into the shuttle.

When the shuttle 5 is opened, the two shells 51 and 52 move apart from each other and from the heating plate 4, and the two capsules 1 and 2 can be introduced one on each side of the heating plate 4, in other words respectively between the first shell 51 and the heating plate 4 and between the second shell 52 and the heating plate 4. This step of inserting the pair of capsules 1 and 2 into the shuttle 5 is performed manually by the user.

Figure 2B:
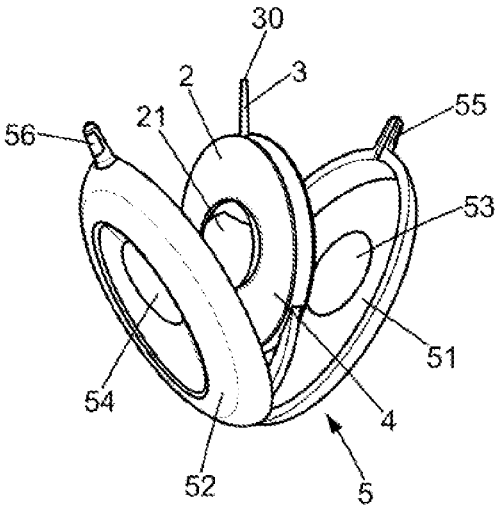
FIG. 2B schematically represents a second step of associating an exemplary shuttle with a pair of capsules according to one embodiment of the invention, which is a step of placing the pair of capsules in the shuttle.

FIG. 2B schematically represents a second step of associating an exemplary shuttle with a pair of capsules according to one embodiment of the invention, which is a step of placing the pair of capsules in the shuttle.

The capsules 1 and 2 are pressed against the heating plate 4, one on each side of the heating plate 4. The male connector 10 fits into the female connector 20, the assembly consisting of the male connector 10 and female connector 20 passing through the hole 40, the outlet passage 3 being housed in the groove 41, the outlet orifice 30 being outside the groove 41. This step of placing the pair of capsules 1 and 2 in the shuttle 5 is performed manually by the user.

Figure 2C:
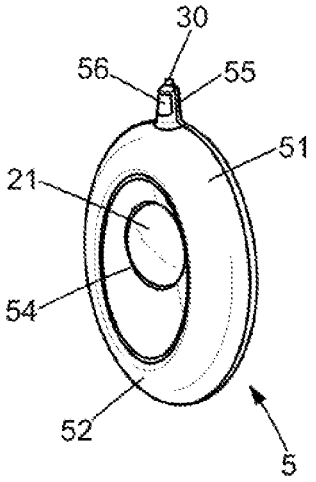
FIG. 2C schematically represents a third step of associating an exemplary shuttle with a pair of capsules according to one embodiment of the invention, which is a step of closing the shuttle containing the pair of capsules.

FIG. 2C schematically represents a third step of associating an exemplary shuttle with a pair of capsules according to one embodiment of the invention, which is a step of closing the shuttle containing the pair of capsules.

The shells 51 and 52 are brought closer to one another until they touch and close together, for example one snap-fitting onto the other. When the shuttle 5 containing the pair of capsules 1 and 2 is closed, the first pouch 11 passes through the first passage 53 to protrude from the shuttle 5, the second pouch 21 passes through the second passage 54 to protrude from the shuttle 5, and the outlet passage 3 passes between the guides 55 and 56 to provide an opening to the outside via its outlet orifice 30. This step of closing the shuttle 5 containing the pair of capsules 1 and 2 is performed manually by the user.

Figure 2D:
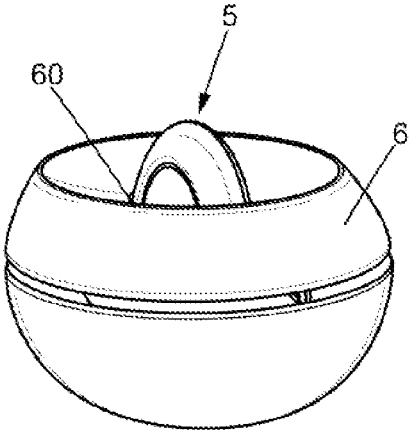
FIG. 2D schematically represents a fourth step of associating an exemplary shuttle with a pair of capsules according to one embodiment of the invention, which is a step of inserting the shuttle containing the pair of capsules into the mixer.

FIG. 2D schematically represents a fourth step of associating an exemplary shuttle with a pair of capsules according to one embodiment of the invention, which is a step of inserting the shuttle containing the pair of capsules into the mixer.

The shuttle 5 is inserted into a mixer 6 whose function is to mix together the first and second phases respectively contained in the capsules 1 and 2, homogenizing the mixture so as to form for example an emulsion which will be the final cosmetic product to be directly and immediately consumed by the user. The shuttle 5 is inserted into the mixer 6, specifically into an opening 60 of the mixer 6, the guides 55 and 56 as well as the outlet orifice 30 entering the opening 60 of the mixer 6 first so that they are housed and possibly nested in the bottom of the opening 60. The shuttle 5 is pushed to the bottom of the opening 60 so that it nests in the opening 60 and is held in place within the opening 60 during the entire mixing operation which will then take place. The guides 55 and 56 are closed one over the other and pressed against each other when they are in the bottom of the opening 60 of the mixer 6, which has the effect of clamping the outlet passage 3 upstream of the outlet orifice 30 so that no phase or cosmetic product can leave the space defined by the pair of capsules 1 and 2 and by the communication channel between these capsules 1 and 2, as long as the shuttle 5 is closed and positioned against the bottom of the opening 60 of the mixer 6. It is the closure and the pressure of the guides 55 and 56 against each other, when the shuttle 5 is closed and positioned against the bottom of the opening 60 of the mixer 6, which mechanically causes the clamping of the outlet passage 3 upstream of the outlet orifice 30. This step of inserting the shuttle 5 containing the pair of capsules 1 and 2 into the mixer 6 is performed manually by the user.

Figure 3A:
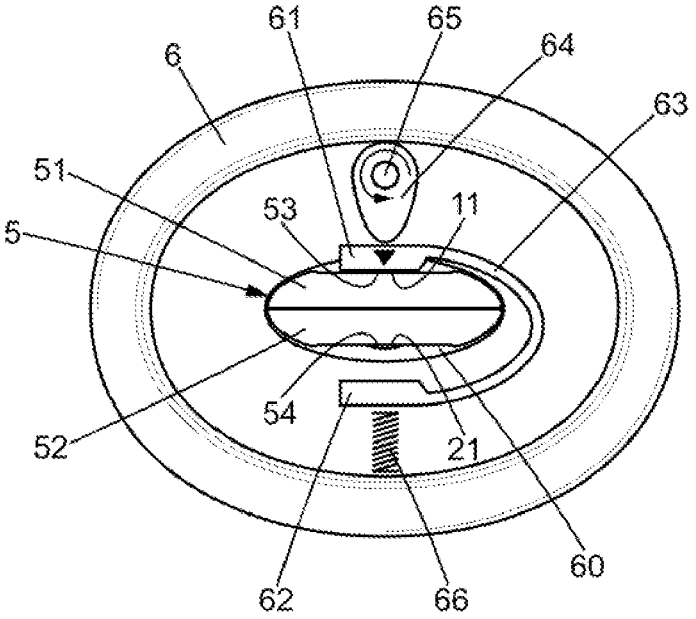
FIG. 3A schematically represents an internal top view of a first alternating phase of operation of the pressure members alternately pressing on one or the other of the capsules contained in the shuttle placed in the mixer, according to one embodiment of the invention.

FIG. 3A schematically represents an internal top view of a first alternating phase of operation of the pressure members alternately pressing on one or the other of the capsules contained in the shuttle placed in the mixer, according to one embodiment of the invention.

Figure 3B:
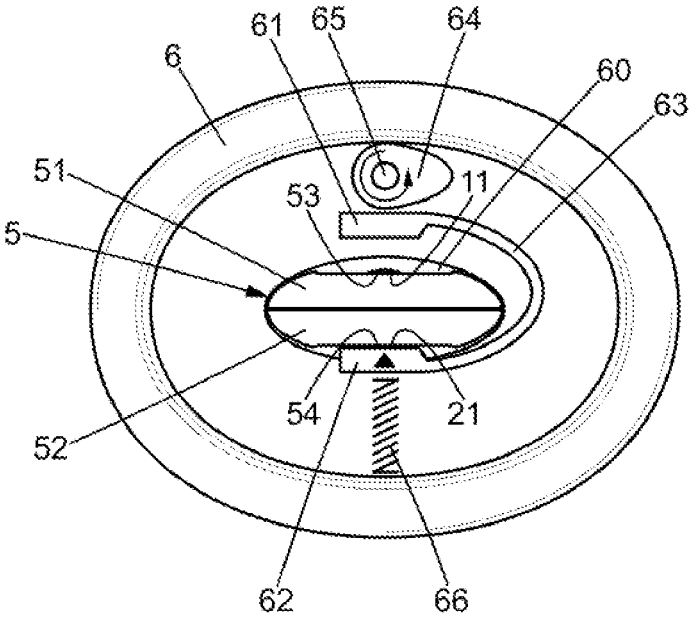
FIG. 3B schematically represents an internal top view of a second alternating phase of operation of the pressure members alternately pressing on one or the other of the capsules contained in the shuttle placed in the mixer, according to one embodiment of the invention.

FIG. 3B schematically represents an internal top view of a second alternating phase of operation of the pressure members alternately pressing on one or the other of the capsules contained in the shuttle placed in the mixer, according to one embodiment of the invention.

The mixer 6 receives the shuttle 5 into its opening 60. Opposite the first shell 51, more specifically facing the first pouch 11 protruding from the first passage 53, is a first pressure member 61, for example a piston or pressure finger, whose lateral movement (vertical and downward in FIG. 3A) indicated by a triangular arrow in FIG. 3A presses on the first pouch 11 of the first capsule 1 in order to empty it of its contents towards the second pouch 21 of the second capsule 2, through an inter-capsule communication channel not visible in FIG. 3A.

Opposite the second shell 52, more specifically facing the second pouch 21 protruding from the second passage 54, is a second pressure member 62, for example a piston or pressure finger, whose lateral movement (vertical and upward in FIG. 3B) indicated by a triangular arrow in FIG. 3B presses on the second pouch 21 of the second capsule 2 in order to empty it of its contents towards the first pouch 11 of the first capsule 1, through an inter-capsule communication channel not visible in FIG. 3B.

The first pressure member 61 and the second pressure member 62 are integral with an arm 63. On one side of the shuttle 5, an oblong cam 64 bears against the first pressure member 61 to push it towards the first shell 51 and towards the first pouch 11. On the other side of the shuttle 5, a compressed spring 66 bears against the second pressure member 62 to push it towards the second shell 52 and the second pouch 21. The alternating lateral pressure movements of the pressure members 61 and 62 on their respective capsules 1 and 2 are caused by the rotation of the oblong cam 64 about an axis of rotation 65, in the direction of the circular arrow.

When the small dimension of the oblong cam 64 is parallel to the center plane of the shuttle 5, the oblong cam 64 presses on the first pressure member 61 which presses on the first pouch 11 to empty its contents into the second pouch 21 through an inter-capsule communication channel not visible in FIGS. 3A and 3B. The arm 63 shifts to one side of the shuttle 5, moving the second pressure member 62 away from the shuttle 5, which compresses the spring 66.

When the large dimension of the oblong cam 64 is parallel to the center plane of the shuttle 5, the spring 66 relaxes and pushes the second pressure member 62 which presses on the second pouch 21 to empty its contents into the first pouch 11 through an inter-capsule communication channel not visible in FIGS. 3A and 3B. The arm 63 shifts to the other side of the shuttle 5, moving the second pressure member 62 away from the shuttle 5 to abut against the oblong cam 64.

During a complete revolution of the oblong cam 64, the arm 63 moves back and forth in translation, the first pressure member 61 first pressing once on the first pouch 11 of the first capsule 1 to empty its contents towards the second pouch 21 of the second capsule 2, the second pressure member 62 then pressing once on the second pouch 21 of the second capsule 2 to empty its contents towards the first pouch 11 of the first capsule 1, and the spring 66 is first compressed once and then relaxes once. This cycle is repeated between 2 and 15 times, preferably between 5 and 10 times, until the mixture of the two phases is properly homogenized, for example well emulsified, so as to form a homogeneous cosmetic product, for example an emulsion, ready for direct and immediate use by the user, the user then applying for example to the facial skin the facial cream thus obtained, which is natural and fresh without preservatives, because the phases are mixed immediately prior to use.

Figure 4A:
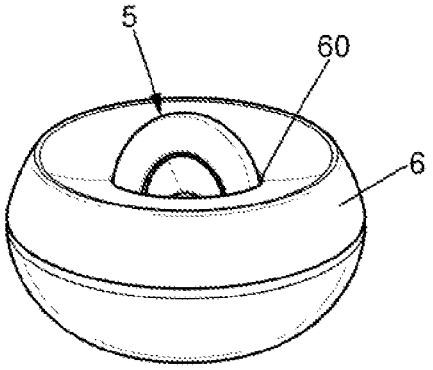
FIG. 4A schematically represents a first step of arranging the mixture of the phases respectively originally contained in the two capsules of the pair of capsules according to one embodiment of the invention, which is a step of stopping the mixing previously being carried out in the mixer.

FIG. 4A schematically represents a first step of arranging the mixture of the phases respectively originally contained in the two capsules of the pair of capsules according to one embodiment of the invention, which is a step of stopping the mixing previously being carried out in the mixer. Once the mixture of the two phases respectively from the two capsules 1 and 2 is properly homogenized, the pressure members 61 and 62 stop their movement relative to the shuttle 5.

Figure 4B:
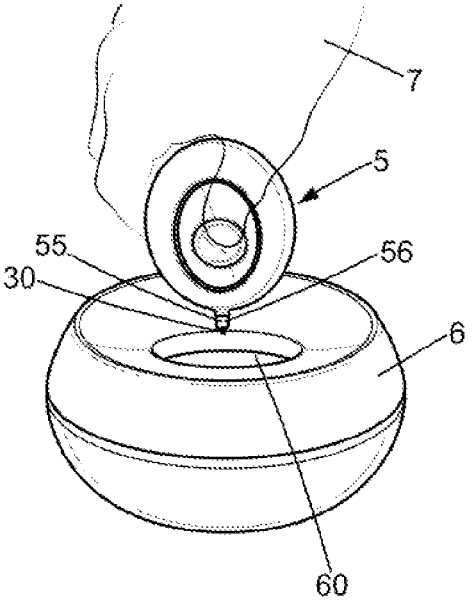
FIG. 4B schematically represents a second step of arranging the mixture of the phases respectively originally contained in the two capsules of the pair of capsules according to one embodiment of the invention, which is a step of extracting the shuttle containing the mixture, from the mixer.

FIG. 4B schematically represents a second step of arranging the mixture of the phases respectively originally contained in the two capsules of the pair of capsules according to one embodiment of the invention, which is a step of extracting the shuttle containing the mixture, from the mixer. The user's hand 7 removes the shuttle 5 from the opening 60 of the mixer 6. The removal of the shuttle 5 from the opening 60 of the mixer 6 causes the mechanical release of the clamping of the outlet orifice 30 by the guides 55 and 56 of the shells 51 and 52.

Figure 4C:
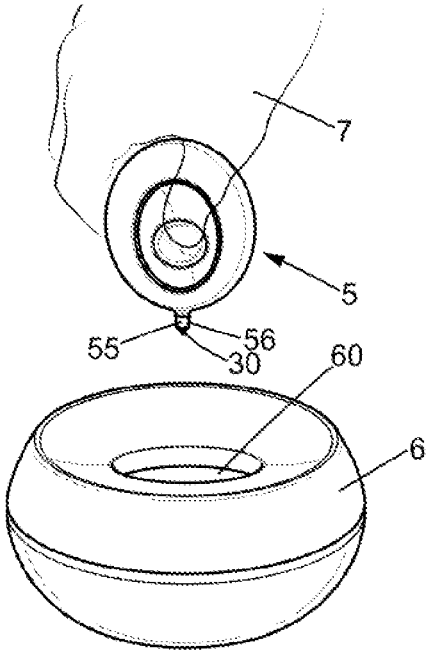
FIG. 4C schematically represents a third step of arranging the mixture of the phases respectively originally contained in the two capsules of the pair of capsules according to one embodiment of the invention, which is a step of moving the shuttle containing the mixture away from the mixer.

FIG. 4C schematically represents a third step of arranging the mixture of the phases respectively originally contained in the two capsules of the pair of capsules according to one embodiment of the invention, which is a step of moving the shuttle containing the mixture away from the mixer. The user's hand 7 moves the shuttle 5 away from the mixer 6 so that the cosmetic product contained in the shuttle 5 can be used, this cosmetic product being the homogenized mixture of the two phases respectively originally contained in the two capsules 1 and 2.

Figure 5:
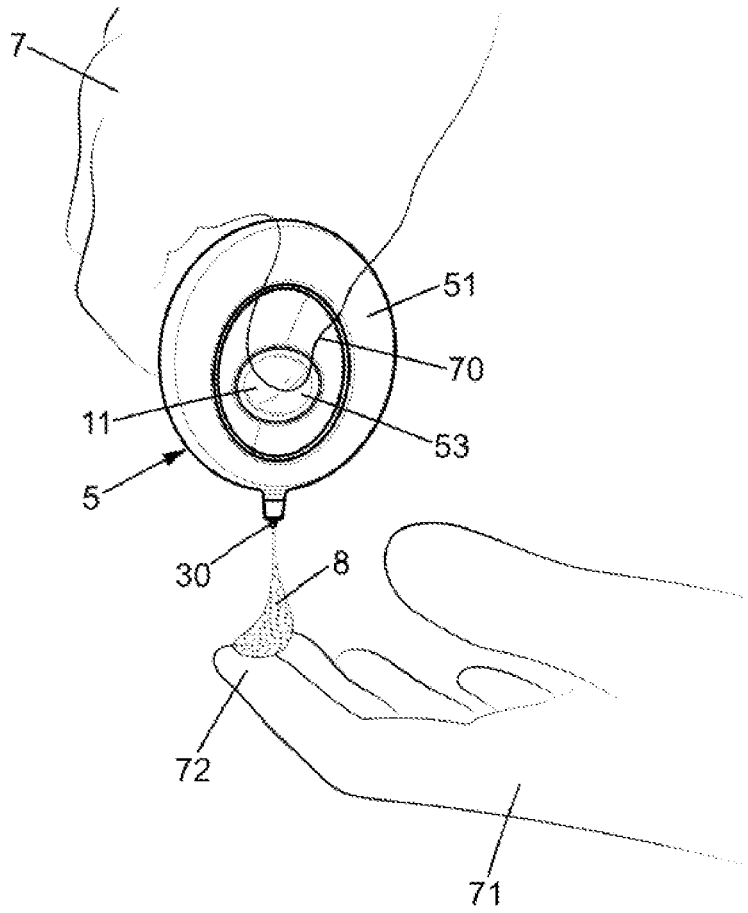
FIG. 5 schematically represents a step of using the mixture of the phases respectively originally contained in the two capsules of the pair of capsules according to one embodiment of the invention.

FIG. 5 schematically represents a step of using the mixture of the phases respectively originally contained in the two capsules of the pair of capsules according to one embodiment of the invention.

The user's hand 7, more specifically one or more fingers 70, for example the thumb, presses simultaneously on each side of the shuttle 5, at the passages 53 and 54 of the shells 51 and 52, on the pouches 11 and 12 of the capsules 1 and 2, to cause the homogenized mixture constituting the ready-to-use cosmetic product 8 to exit through the outlet orifice 30 which is no longer clamped. This ready-to-use cosmetic product 8 exits through the outlet orifice 30, and gravity causes it to fall onto the fingers 72 of the user's other hand 71 which is positioned to receive this cosmetic product 8. With this cosmetic product 8 in his or her hand 71, the user can use it directly and immediately, for example spreading the skincare cream 8 on the face with his or her hand 71.

Figure 6:
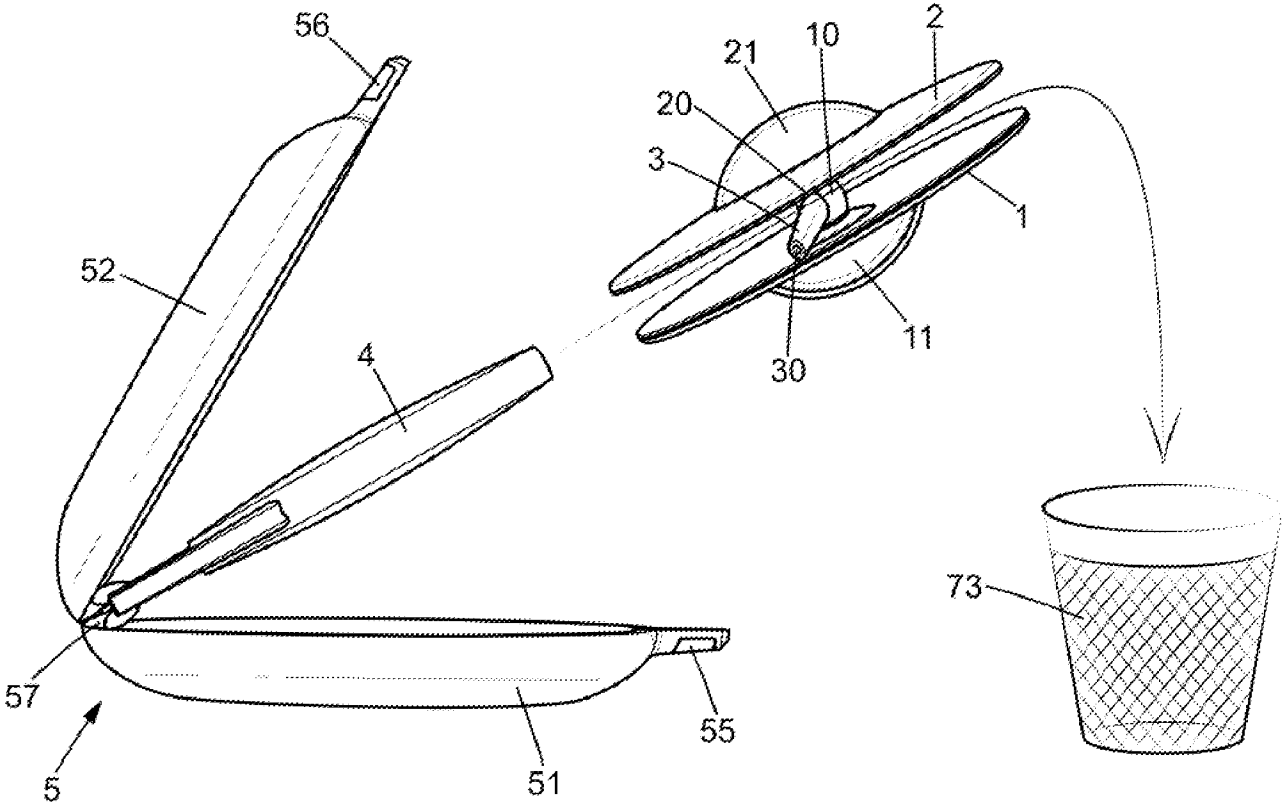
FIG. 6 schematically represents a step of removing the pair of capsules according to one embodiment of the invention, from the shuttle.

FIG. 6 schematically represents a step of removing the pair of capsules according to one embodiment of the invention, from the shuttle.

The shells 51 and 52 have been moved apart from each other. The user removes the pair of capsules 1 and 2 from the shuttle 5, after detaching the capsules 1 and 2 from the heating plate 4. The user can then discard this pair of capsules 1 and 2 into a waste receptacle 73, for example a trash can 73.

Figure 7A:
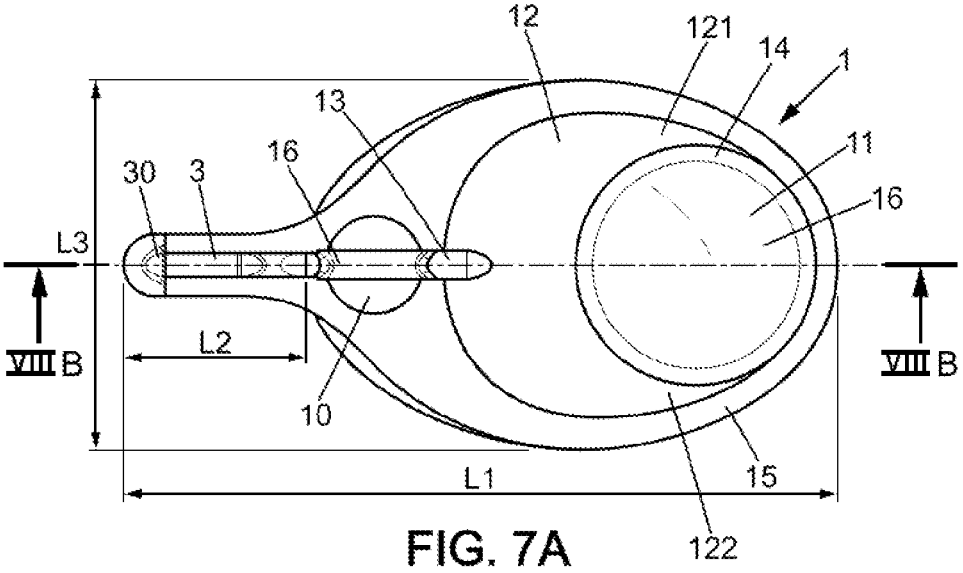
FIG. 7A represents a top view of an exemplary pair of capsules according to one embodiment of the invention, assembled together when placed in the shuttle.

FIG. 7A represents a top view of an exemplary pair of capsules according to one embodiment of the invention, assembled together when placed in the shuttle.

Figure 7B:
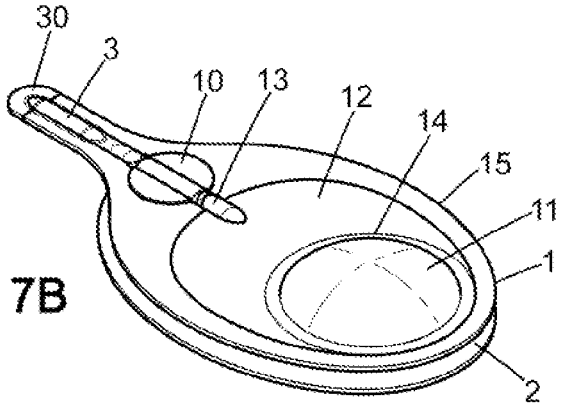
FIG. 7B represents a perspective view of an exemplary pair of capsules according to one embodiment of the invention, assembled together when placed in the shuttle.

FIG. 7B represents a perspective view of an exemplary pair of capsules according to one embodiment of the invention, assembled together when placed in the shuttle.

A first capsule 1 comprises a first pouch 11 containing a first phase intended to be mixed with a second phase from a second pouch 21 of a second capsule 2 in order to yield a homogenized mixture, for example an emulsion, forming the ready-to-use cosmetic product directly and immediately usable by the user.

The first capsule also comprises a first buffer zone 12. The first pouch 11 is separated from the first buffer zone 12 by a first weak frangible weld 14. The assembly consisting of the first pouch 11 and the first buffer zone 12 is surrounded by a first strong weld 15 significantly stronger than the first weak frangible weld 14.

When the first weak weld 14 is broken by pressure exerted on the first pouch 11, the first phase contained in the first pouch 11 will first flow into the first buffer zone 12 and then into the segment 13 of the inter-capsule communication channel which is continued by a male connector 10 in the direction of the second capsule 2 and by an outlet passage 3 in the direction of an outlet orifice 30.

All the three-dimensional contours of the first capsule 1 are formed by a thermoformed shell 16. The total length L1 of the first capsule 1 is for example 70.8 mm. The length L2 of the outlet passage 3 is for example 18.15 mm. The total width L3 of the first capsule 1 is for example 36.5 mm.

The first disposable deformable capsule 1 comprises a predetermined amount of a first phase of a cosmetic product, and also comprises a first pouch 11 containing this first phase of cosmetic product, an outlet orifice 30 leading to outside the first capsule 1, a unobstructed channel including the first buffer zone 12, the segment 13, and the outlet passage 3, and connecting the first pouch 11 to the outlet orifice 30 with a narrowing along part of its length, a first frangible wall 14 separating the first pouch 11 from this unobstructed channel, the entire first phase of cosmetic product filling the entire first pouch 11, rupture of the first frangible wall 14 resulting in at least a portion of the first phase of cosmetic product entering this unobstructed channel, no other frangible wall being located in this unobstructed channel between the first pouch 11 and the outlet orifice 30.

The first disposable deformable capsule 1 comprises a first pouch 11 containing a predetermined amount of only one of the two phases which when mixed form a ready-to-use cosmetic product, a first empty buffer zone 12 separated from the first pouch 11 by a first frangible wall 14, no cosmetic component being in the first buffer zone 12, and a channel portion including the segment 13 and the outlet passage 3 which leads at one side to the first buffer zone 12 and at the other side to outside the first capsule 1 at the outlet orifice 30.

Before the first frangible wall 14 is ruptured, the first empty buffer zone 12 is in a completely flattened position in which the walls of the first buffer zone 12 are arranged one against the other.

After the first frangible wall 14 is ruptured, the first pouch 11 extends into the first buffer zone 12 and thus includes it, increasing the volume of the now-extended first pouch 11.

Advantageously, the first pouch 11 has a generally convex shape in the plane of the flattened first pouch 11 which is also the plane of FIG. 7A, and the first buffer zone 12 has a generally concave shape in the plane of the flattened first pouch 11, complementary to the generally convex shape of the first pouch 11. The assembly consisting of the first pouch 11 and the first buffer zone 12 has a generally convex shape in the plane of the flattened first pouch 11. The first pouch 11 has a generally circular shape in the plane of the flattened first pouch 11, and the first buffer zone 12 has a general U-shape in the plane of the first pouch 11, with arms 121 and 122 that are thinner towards their ends.

Figure 7C:
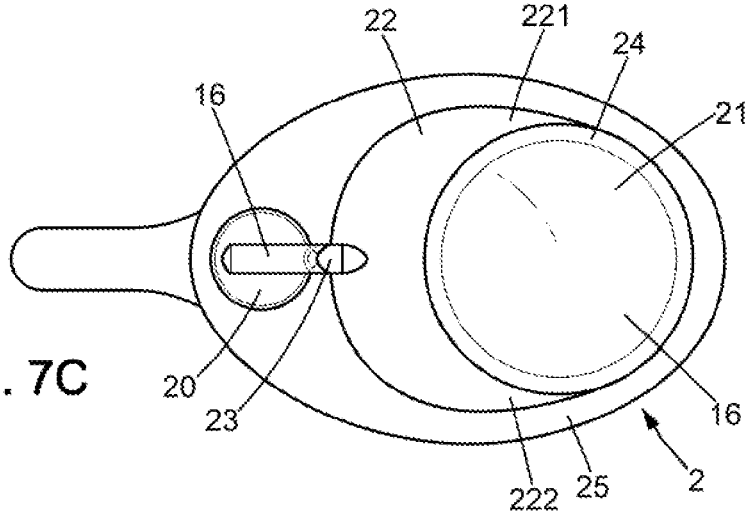
FIG. 7C represents a view from below of an exemplary pair of capsules according to one embodiment of the invention, assembled together when placed in the shuttle.

FIG. 7C represents a view from below of an exemplary pair of capsules according to one embodiment of the invention, assembled together when placed in the shuttle.

A second capsule 2 is similar to the first capsule 1. The second capsule 2 comprises a second pouch 21 containing a second phase intended to be mixed with the first phase from the first pouch 11 of the first capsule 1 in order to yield the homogenized mixture, for example an emulsion, forming the ready-to-use cosmetic product directly and immediately usable by the user.

The second capsule also comprises a second buffer zone 22. The second pouch 21 is separated from the second buffer zone 22 by a second weak frangible weld 24. The assembly consisting of the second pouch 21 and the second buffer zone 22 is surrounded by a second strong weld 25 significantly stronger than the second weak frangible weld 24.

When the second weak weld 24 is ruptured by pressure exerted on the second pouch 21, the second phase contained in the second pouch 21 will first flow into the second buffer zone 22 and then into the segment 23 of the inter-capsule communication channel which is continued by a female connector 20 in the direction of the first capsule 1.

All the three-dimensional contours of the second capsule 2 are formed by a thermoformed shell 16. The second buffer zone 22 has, in the plane of the flattened second pouch 21, a general U-shape with arms 221 and 222 that are thinner towards their ends.

Figure 8A:
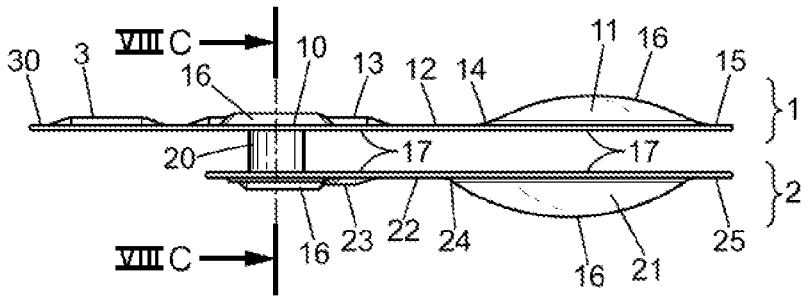
FIG. 8A represents a side view of an exemplary pair of capsules according to one embodiment of the invention, assembled together when placed in the shuttle.

FIG. 8A represents a side view of an exemplary pair of capsules according to one embodiment of the invention, assembled together when placed in the shuttle.

The thermoformed shell 16 forms the three-dimensional portions of the capsules 1 and 2. A flat film 17 covers the thermoformed shell 16, both for the first capsule 1 and the second capsule 2. The inter-capsule communication channel comprises a first right-angle bend formed by segment 13 and the male connector 10 fitted into the female connector 20, as well as a second right-angle bend formed by the male connector 10 fitted into the female connector 20 and segment 23. Flow of the mixture between the pouches 11 and 21 follows a path forming the three sides of a rectangle, the first long side comprising the first pouch 11, the first buffer zone 12, and segment 13, the second long side comprising the second pouch 21, the second buffer zone 22, and segment 23, the short side joining said two long sides and comprising the male connector 10 fitted into the female connector 20.

The pair of capsules 1 and 2 assembled together respectively comprise two different phases to be mixed in order to obtain a personalized cosmetic product, and comprise two pouches 11 and 21 respectively containing the two different phases and respectively included in the two capsules 1 and 2 and interconnected by a communication channel comprising at least one portion of narrow cross-section relative to the two pouches 11 and 21, this narrow portion of the communication channel comprising two right-angle bends, the first bend comprising channel portions 13 and 10 at right angles to each other, the second bend comprising channel portions 23 and 10 at right angles to each other. These two right-angle bends are arranged such that at least part of the narrow portion of the communication channel comprising the two right-angle bends forms the three sides of a rectangle.

Each disposable deformable capsule 1 or 2 comprises an extended pouch 11 and 12 (or 21 and 22) containing a predetermined amount of only one of the two phases which when mixed form a ready-to-use cosmetic product, and a narrowing which forms a channel leading at one side into the extended pouch 11 and 12 (or 21 and 22) and at the other side to outside the capsule 1 or 2. Each extended pouch 11 and 12 (or 21 and 22) is flattened, one of its two faces being flat, the other of its two faces being at least partly convex and flexible to allow expelling the contents of the extended pouch 11 and 12 (or 21 and 22) by mechanical pressure on said pouch.

Each extended pouch 11 and 12 (or 21 and 22) comprises two compartments 11 and 12 (or 21 and 22), separated by a frangible wall 14 or 24, the actual pouch 11 or 21, and the adjoining buffer zone 12 or 22 into which the actual pouch 11 or 21 will be able to extend after rupture of the frangible wall 14 or 24. As the phase is only located in the compartment 11 or 21 not opening into this channel 13 or 23, only this compartment 11 or 21 comprising the phase is convex before rupture of the frangible wall 14 or 24. This phase will therefore be well preserved, for example during storage, because the frangible wall 14 or 24 separating the two compartments 11 and 12 (or 21 and 22) of the extended pouch 11 and 12 (or 21 and 22) allows vacuum filling and sealing the phase in the corresponding pouch 11 and 12 (or 21 and 22).

Figure 8B:
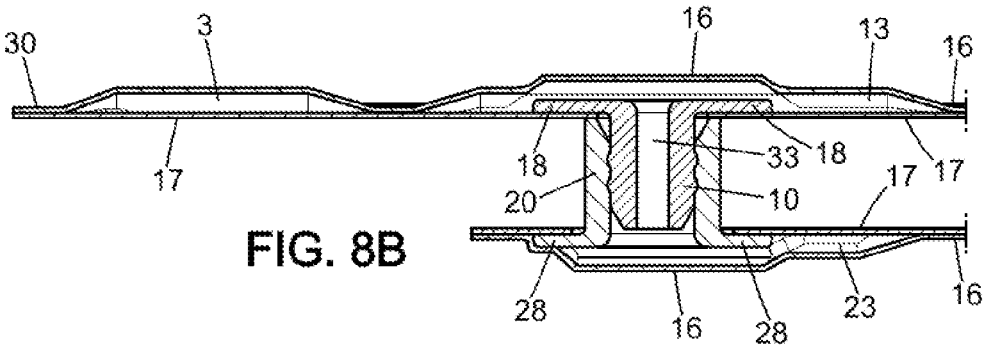
FIG. 8B shows an enlargement of a partial sectional view along axis AA, of an exemplary pair of capsules of FIG. 7A.

FIG. 8B shows an enlargement of a partial sectional view along line VIIIB-VIIIB, of an exemplary pair of capsules of FIG. 7A.

The male connector 10 fits into the female connector 20. The male connector 10 and the female connector 20 are made of rigid plastic.

On the side of the first capsule 1, the male connector 10 has a flange 18 located at its base in a plane perpendicular to the axis of the male connector 10 fitted into the female connector 20. Inside the male connector 10, the narrow channel portion 33 establishes the fluid connection between the channel segment 13 also of narrow cross-section that is part of the first capsule 1 and the channel segment 23 also of narrow cross-section that is part of the second capsule 2. This flange 18 increases the sturdiness of the first right-angle bend of the inter-capsule communication channel.

On the side of the second capsule 2, the female connector 20 has a flange 28 located at its base in a plane perpendicular to the axis of the male connector 10 fitted into the female connector 20. Inside the male connector 10, the narrow channel portion 33 establishes the fluid connection between the channel segment 13 also of narrow cross-section that is part of the first capsule 1 and the channel segment 23 also of narrow cross-section that is part of the second capsule 2. This flange 28 increases the sturdiness of the second right-angle bend of the inter-capsule communication channel.

Figure 8C:
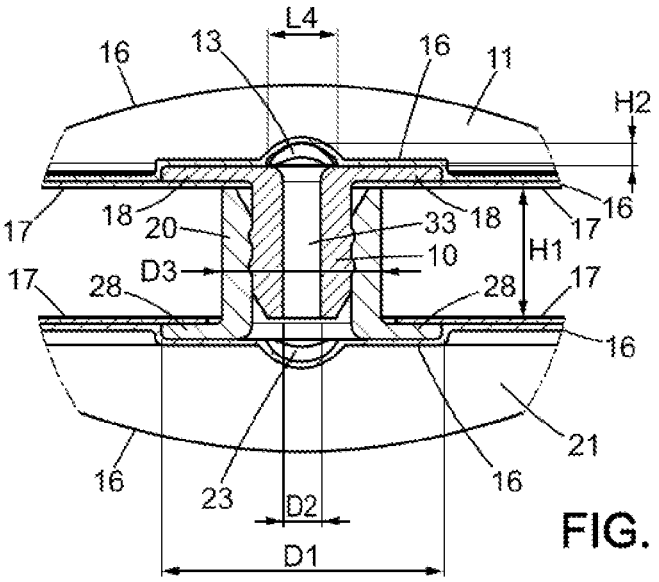
FIG. 8C shows an enlargement of a partial sectional view along axis BB, of an exemplary pair of capsules of FIG. 8A.

FIG. 8C shows an enlargement of a partial sectional view along line VIIIC-VIIIC, of an exemplary pair of capsules of FIG. 8A.

Channel segment 13 of narrow cross-section, narrow channel portion 33, and channel segment 23 of narrow cross-section all have the same value for the narrow cross-section.

The width L4 of segment 13 and segment 23 is for example 2.31 mm. The outside diameter D1 of the flanges 18 and 28 is for example 9.30 mm. The inside diameter D2 of the narrow channel portion 33 is for example 1.3 mm. The outside diameter D3 of the female connector 20 is for example 5.30 mm. The height H1 of the male connector 10 and the female connector 20 is for example 4.30 mm. The height H2 of segment 13 and segment 23 is for example 0.75 mm.

Of course, the invention is not limited to the examples and embodiment described and represented, but is suitable for many variants accessible to those skilled in the art.

The invention claimed is:

1. A pair of capsules assembled together, the pair of capsules comprising:

two pouches respectively containing two different phases respectively included in a respective capsule of the pair of capsules, the two different phases to be mixed in order to obtain a personalized cosmetic product, the two pouches being interconnected by a communication channel comprising at least one portion of narrow cross-section relative to the two pouches, the at least one portion of narrow cross-section of the communication channel comprising two right-angle bends, a first of the two right-angle bends being formed by a segment of the communication channel and a male connector fitted into a female connector, a second of the two right-angle bends being formed by the male connector fitted into the female connector and another segment of the communication channel, wherein the male connector and the female connector are respectively part of the two capsules and fit one inside the other, and wherein one of said bends is disposed at an inner end of the male connector which is opposite an outer end of the male connector configured to fit first into an outer end of the female connector, and the other of said bends is disposed at an inner end of the female connector which is opposite the outer end of the female connector configured to fit first into the outer end of the male connector.

2. The pair of capsules according to claim 1, wherein the two right-angle bends are disposed such that at least part of the at least one portion of narrow cross-section of the communication channel comprising the two right-angle bends forms three sides of a rectangle.

3. The pair of capsules according to claim 2, wherein the ratio between the narrow cross-section of the communication channel and the cross-section of one or the other of said pouches is sufficiently small to cause shear of the mixture of formulations which passes through the communication channel.

4. The pair of capsules according to claim 1, wherein the male and female connectors fitted one inside the other are disposed in an intermediate side of three sides of a rectangle formed by the communication channel, which is orthogonal to the other two sides of the rectangle.

5. The pair of capsules according to claim 1, wherein the male connector is a molded plastic hollow tube with a molded plastic flange located opposite an outer end of the male connector, and the female connector is a molded plastic hollow tube with a molded plastic flange located opposite an outer end of the female connector.

6. The pair of capsules according to claim 5, wherein each of the flanges is welded to a film closing one of the pouches of the respective capsule which does not contain said flange.

7. The pair of capsules according to claim 1, wherein each of the pouches is flattened, one face of two faces of the respective pouch being flat, the other face of the two faces of the respective pouch being at least partly convex and flexible to allow expelling contents of the respective pouch by mechanical pressure on the respective pouch.

8. The pair of capsules according to claim 7, wherein the at least partly convex face of the pouch is formed by a thermoformed shell containing said phase, and the flat face of the pouch is formed by a film covering the thermoformed shell.

9. The pair of capsules according to claim 8, wherein the thermoformed shell is multilayer and comprises an inner layer of polyolefin polymer, and the film is multilayer and comprises an inner layer of polyolefin polymer.

10. The pair of capsules according to claim 7, wherein the flat faces of the two capsules are arranged face-to-face.

11. The pair of capsules according to claim 1, wherein the capsules are disposable deformable capsules.

12. The pair of capsules according to claim 1, wherein the capsules are arranged opposite one another.

13. The pair of capsules according to claim 1, wherein the at least one portion of narrow cross-section of the channel has, for at least part of its length, a cross-section smaller than 10 $mm^2$.

14. The pair of capsules according to claim 1, wherein another portion of the channel is of constant cross-section along most of the length of the channel.

15. The pair of capsules according to claim 14, wherein the other portion of constant cross-section has a cross-section of between 0.5 and 3 $mm^2$.

16. The pair of capsules according to claim 14, wherein the other portion of constant cross-section has a size or diameter which is at most 20% of the size or diameter of the pouch.

17. The pair of capsules according to claim 16, wherein the other portion of constant cross-section has a size or diameter which is at least 2% of the size or diameter of the pouch.

18. A pair of capsules assembled together, the pair of capsules comprising:

two pouches respectively containing two different phases respectively included in a respective capsule of the pair of capsules, the two different phases to be mixed to obtain a personalized cosmetic product, the two pouches being interconnected by a communication channel comprising at least one portion of narrow cross-section relative to the two pouches, the at least one portion of narrow cross-section of the communication channel comprising at least two portions parallel to each other and a connection between the at least two portions, at least one portion of the at least two portions comprising two right-angle bends, a first of the two right-angle bends being formed by a segment of the communication channel and a male connector fitted into a female connector, a second of the two right-angle bends being formed by the male connector fitted into the female connector and another segment of the communication channel, wherein the male connector and the female connector are respectively part of the two capsules and fit one inside the other, and wherein one of said bends is disposed at an inner end of the male connector which is opposite an outer end of the male connector configured to fit first into an outer end of the female connector, and the other of said bends is disposed at an inner end of the female connector which is opposite the outer end of the female connector configured to fit first into the outer end of the male connector.

19. The pair of capsules according to claim 18, wherein a general shape of the connection is substantially perpendicular to the at least two portions, with two curved connections between said connection and respectively the at least two portions.

20. The pair of capsules according to claim 18, wherein the connection is substantially perpendicular to the at least two portions.

21. A capsule comprising:

a pouch containing a phase of two phases that when mixed form a personalized cosmetic product, the phase being included in the capsule; and a communication channel comprising at least one portion of narrow cross-section relative to the pouch, the communication channel being configured to connect the capsule to another capsule having a pouch containing the other of the two phases of said mixture, a part of the at least one portion of narrow cross-section of the communication channel comprising a right-angle bend formed by a segment of the communication channel and a male connector fitted into a female connector, the portion of narrow cross-section of the communication channel comprises either a male connector part or a female connector part which is part of one of the two capsules and which fits into either a female connector part or a male connector part which is part of the other one of the two capsules, wherein the right-angle bend is disposed at an inner end of the male connector which is opposite an outer end of the male connector configured to fit first into an outer end of the female connector, or the right-angle bend is disposed at an inner end of the female connector which is opposite the outer end of the female connector configured to fit first into the outer end of the male connector.

22. A capsule comprising:

a pouch containing a phase of two phases that when mixed form a personalized cosmetic product, the phase being included in the capsule; and a communication channel comprising at least one portion of narrow cross-section relative to the pouch, the communication channel being configured to connect the capsule to another capsule having a pouch containing the other of the two phases of said mixture, a part of the at least one portion of narrow cross-section of the communication channel comprising a right-angle bend formed by a segment of the communication channel and a male connector fitted into a female connector, the portion of narrow cross-section of the communication channel comprises either a male connector part or a female connector part which is part of one of the two capsules and which fits into either a female connector part or a male connector part which is part of the other one of the two capsules, wherein the male connector is a molded plastic hollow tube with a molded plastic flange located opposite an outer end of the male connector, or the female connector is a molded plastic hollow tube with a molded plastic flange located opposite an outer end of the female connector.

23. The pair of capsules according to claim 22, wherein said molded plastic flange is welded to a film closing one of the pouches of the respective capsule which does not contain said molded plastic flange.

24. A pair of capsules assembled together, the pair of capsules comprising:

two pouches respectively containing two different phases respectively included in a respective capsule of the pair of capsules, the two different phases to be mixed in order to obtain a personalized cosmetic product, the two pouches being interconnected by a communication channel comprising at least one portion of narrow cross-section relative to the two pouches, the at least one portion of narrow cross-section of the communication channel comprising two right-angle bends, a first of the two right-angle bends being formed by a segment of the communication channel and a male connector fitted into a female connector, a second of the two right-angle bends being formed by the male connector fitted into the female connector and another segment of the communication channel, wherein the male connector and the female connector are respectively part of the two capsules and fit one inside the other, and wherein the male connector is a molded plastic hollow tube with a molded plastic flange located opposite an outer end of the male connector, and the female connector is a molded plastic hollow tube with a molded plastic flange located opposite an outer end of the female connector.

25. The pair of capsules according to claim 24, wherein each of the flanges is welded to a film closing one of the pouches of the respective capsule which does not contain said flange.

* * * * *